United States Patent [19]

Wüsthof et al.

[11] Patent Number: 4,704,948

[45] Date of Patent: Nov. 10, 1987

[54] RADIAL PISTON MACHINE

[75] Inventors: Peter Wüsthof, Lohr, Fed. Rep. of Germany; Sinclair Cunningham, Kinghorn, Scotland

[73] Assignee: Mannesmann Rexroth GmbH, Lohr, Fed. Rep. of Germany

[21] Appl. No.: 893,893

[22] Filed: Jul. 29, 1986

[30] Foreign Application Priority Data

Aug. 30, 1985 [DE] Fed. Rep. of Germany ..... 3530979

[51] Int. Cl.[4] ..... F04C 9/00

[52] U.S. Cl. ..... 92/58; 92/72; 91/491

[58] Field of Search ..... 92/12.1, 58, 72, 148; 91/491

[56] References Cited

U.S. PATENT DOCUMENTS 3,046,950 7/1962 Smith ..... 91/491 X
4,581,895 4/1986 Kress ..... 91/491 X

FOREIGN PATENT DOCUMENTS 1217713 5/1966 Fed. Rep. of Germany ..... 91/491
161192 10/1962 U.S.S.R. ..... 92/58

*Primary Examiner*—A. Michael Chambers
*Assistant Examiner*—John C. Fox
*Attorney, Agent, or Firm*—Michael J. Striker

[57] ABSTRACT

A radial piston machine includes a stationary cam plate and a rotational cylinder block provided with radial bores receiving a plurality of radial pistons displaceable in those bores and supported against the cam plate surrounding the cylindrical block by rollers. Each piston has in the region of supporting the roller a web which is cured and supported in one of the grooves formed in the cam plate.

4 Claims, 6 Drawing Figures

RADIAL PISTON MACHINE

BACKGROUND OF THE INVENTION

The present invention relates to a radial piston machine.

Radial piston machines of the type under discussion include a ring-shaped cam plate fixed in the housing of the machine, a cylinder block rotationally positioned in the cam plate and provided with a plurality of radially extended bores receiving pistons displaceable in those bores and cylindrical rollers for supporting respective pistons against the cam track of the cam plate. In such hydraulically operated radial piston machines disclosed, for example in DE patent No. 3,216,007, the portion of the piston supporting the roller is slotted. Thereby two thin walls result, which are slightly deformable when forces act on the pistons. This mechanical instability negatively affects, upon the pressure loading of the piston, the mechanical efficiency of the radial piston machine, specifically the starting output of the machine and its slow running behavior. Practical measurements have shown that the starting output of such conventional radial piston machines is not higher than 60% and that a continual rotational movement below 10 u/min is not possible.

SUMMARY OF THE INVENTION

It is an object of the present invention to provide an improved radial piston machine.

It is another object of this invention to provide a radial piston machine in which the starting output would be enhanced and the slow-running behavior would be improved.

These and other objects of the invention are attained by a radial piston machine, comprising a housing, a ring-shaped cam plate secured to the housing; a cylinder block supported in said housing rotationally about an axis of said cam plate, said cylinder block having a plurality of bores radially extending from an axis of rotation of said block; a plurality of pistons displaceably positioned in said bores; a plurality of cylindrical rollers supporting said pistons against said cam plate and each having an axis extending parallel to said axis of rotation, each piston having a transverse bore receiving at least partially a respective roller; and means for axially holding each roller in position in a respective transverse bore, said holding means including stops secured to said cylinder block and abutting against opposite end faces of the respective roller, each piston including a curved web formed coaxially to an axis of the roller received in said piston, said web surrounding said roller, said cam plate having a plurality of circular grooves each receiving the web of the respective piston.

The web may be formed of one piece with the respective piston. Each piston may include a bearing shell for supporting the roller, said bearing shell being positioned in said transverse bore.

The bearing shell may have flanges provided at both sides of said web so as to anchor said bearing shell to said steg in a locking position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
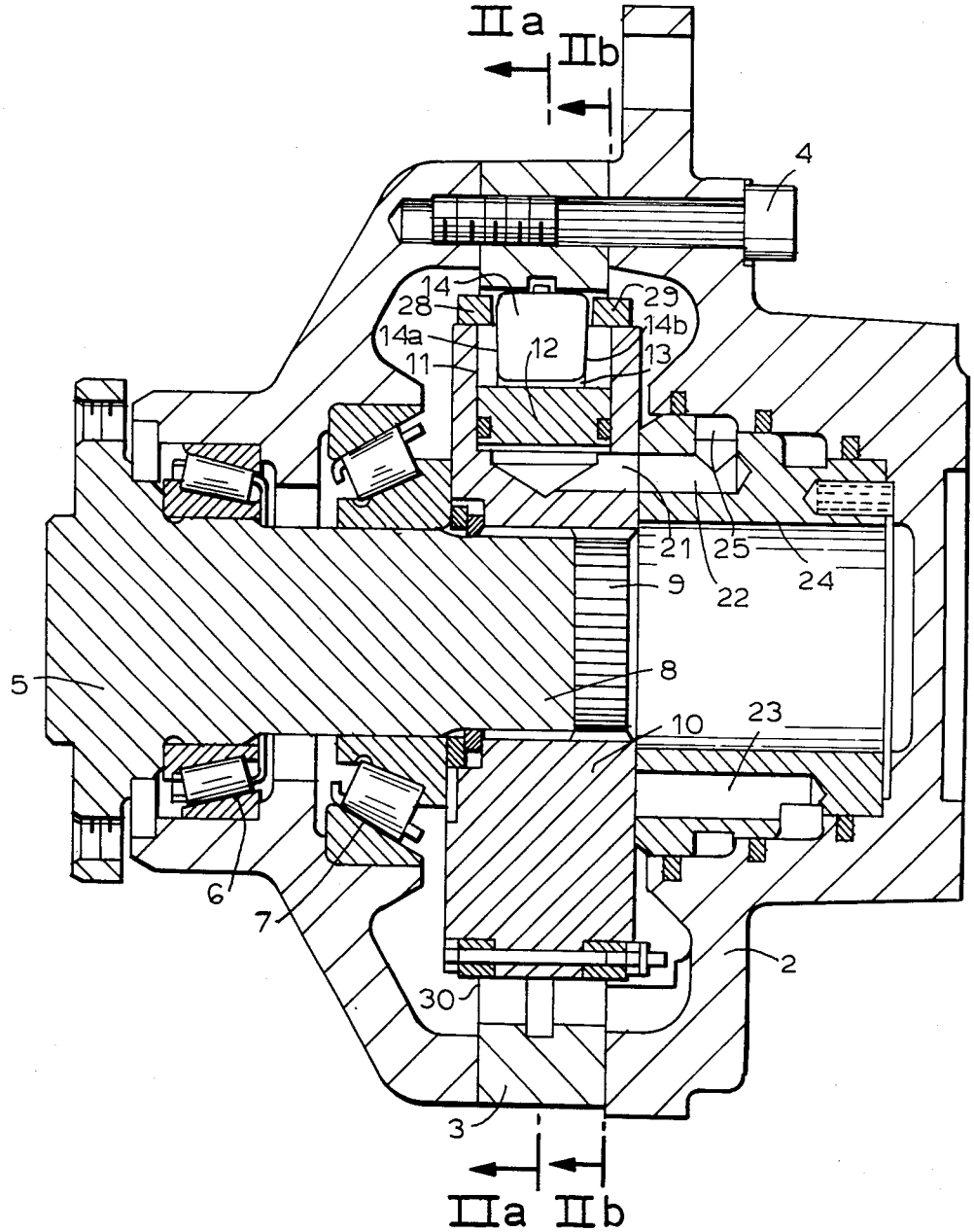
FIG. 1 is a sectional view through a radial piston machine according to the invention.

Referring now to the drawings in detail, and firstly to FIG. 1 thereof, it will be seen that reference numerals 1 and 2 designate two respective halves of the housing of the radial piston machine of this invention. A cam plate 3 is positioned between housing halves 1 and 2. Both housing halves are combined with the cam plate 3 into a single integral unit by means of fastening bolts 4.

Figure 2A:
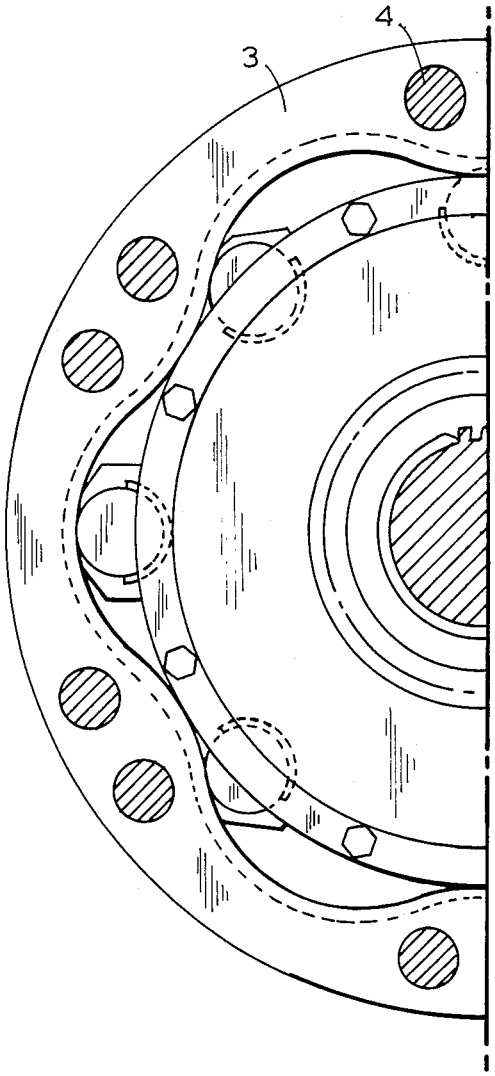
FIG. 2 illustrates at the left-hand half thereof a sectional view taken alone line IIb—IIb of FIG. 1, and at the right-hand half thereof a sectional view taken along line IIa—IIa of FIG. 1.
Figure 2B:
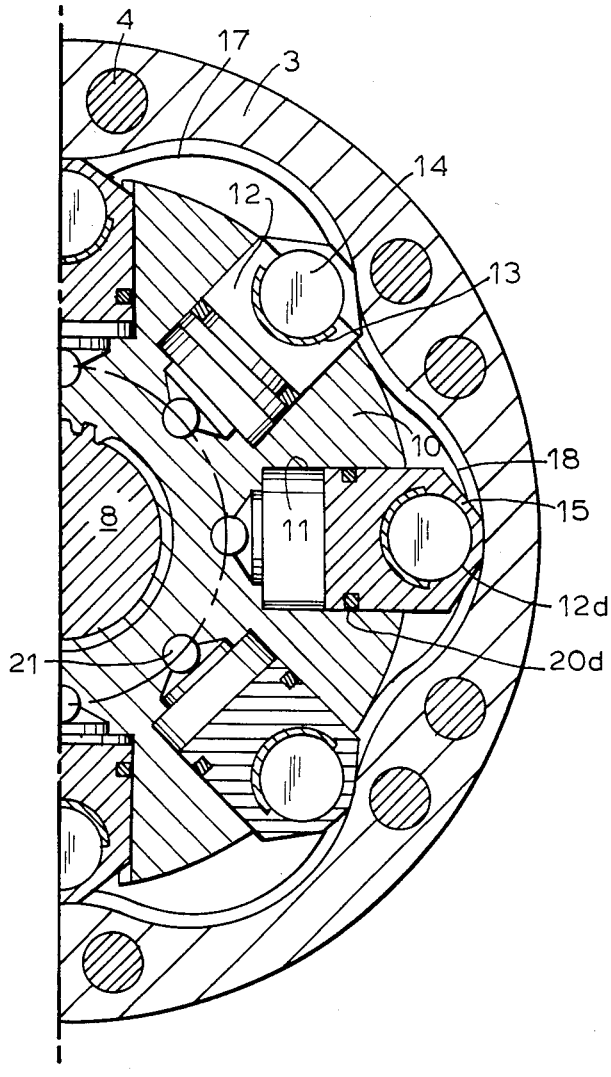
Figure 3:
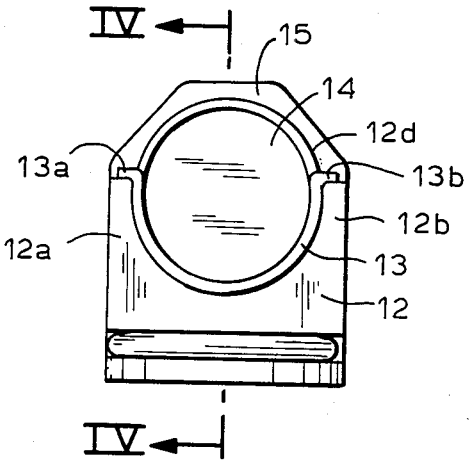
FIG. 3 is a front view of the piston with the roller in the direction of the roller axis.

A shaft 5 is arranged in the housing half 1 with the aid of roller bearings 6, 7. The housing side end 8 of the shaft 5 is formed as a splined shaft and supports via a respective recess 9 a rotor 10. The rotor is formed as a cylinder block in which uniformly spaced bores or recesses 11 are provided at its periphery. These bores are also seen in FIG. 2. Bores 11 received radial pistons 12. Pistons 12 are each provided at the outer radial portions thereof with a recess 12d which receives a bearing shell 13 and a cylindrical roller 14. The outer piston portion 15 enclosing the roller 14 is merely a small cross-piece or web which holds together two halves **12*a*, 12*b* (FIG. 3) of the tongue-shaped piston in the region of the recess and thereby connacts the split part of the piston to each other during operation. Rollers 14 are supported on a curved path 17 of the cam plate 3. The remaining web 15 freely moves in a circular groove 18 at a respective location of the curved path 17**.

Figure 4:
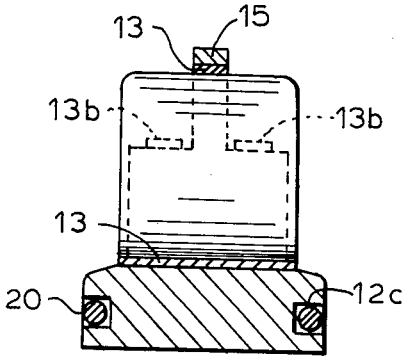
FIG. 4 is a sectional view along line IV—IV of FIG. 3.
Figure 5:
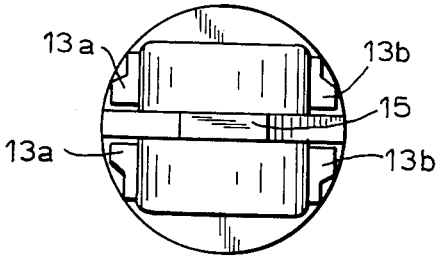
FIG. 5 is a top plan view of the piston.
Figure 6:
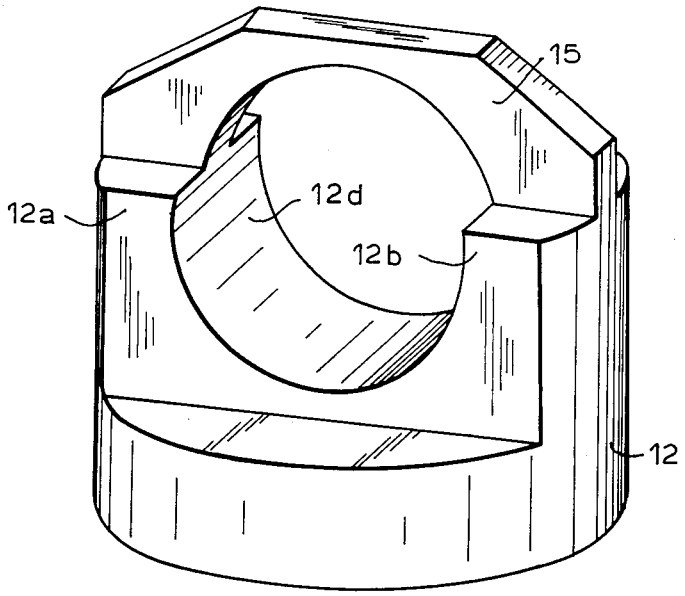
FIG. 6 is a perspective view of the piston.

The bearing shell 13 is flanged to the both sides of the web 15. The flanged portions of the bearing shell are designated in FIGS. 3, 4 and 5 with reference numerals **13*a* and 13*b*. Due to the flanging of the bearing shell in certain regions the form-locking anchoring of the bearing shell with the piston is obtained. Each piston has in the lower or internal region thereof a sealing ring 20 positioned in a circular groove 12*c* as clearly shown in FIG. 4. The piston chambers formed by recesses 11 are in operational connection with axially extending control 22, 23 as shown in FIG. 1, via axially extending bores 21 of a stationarily positioned control sleeve 24. The latter limits annular control chambers 25, 26 which are in connection with non-illustrated connection conduits for a pressure medium source or a tank. Depending on the position of the respective piston chambers or recess 11 relative to control bores 22, 23 these piston chambers become connected either with the pressure medium source or with the tank and thereby a torque is generated on the rotor 10 which, via the spline shaft 30 of the drive or driven shaft 5 pass on the rotor 10** in the outward direction.

Rollers 14 are held or fixed at their end surfaces **14*a*, 14*b* (FIG. 1) by supporting rings or stops 28 and 29 in the axial direction. The supporting rings are rigidly secured to the rotor 10 by fastening bolts 30. Due to the connection of the both relatively thin side walls 12***a*, 12*b* of the piston by web 15 these walls have high inherent stability. The starting output of the device according to the invention is enhanced from 60 to 80% and a slow-running behavior of the device is respectively improved. The remaining narrow web is obtained in a simple manner such that the respective portions are milled of to the both sides of the piston. The bearing shell 13 is closed in the region of the shell so that each roller is guided also at its radially outer portion.

Flanges 13*a*, 13*b* ensure high stability of the bearing shell 13 (FIGS. 4 and 5) and anchor the bearing shell to web 15.

It will be understood that each of the elements described above, or two or more together, may also find a useful application in other types of radial piston machines differing from the types described above.

While the invention has been illustrated and described as embodied in a radial piston machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a radial piston machine, comprising a housing, a ring-shaped cam plate secured to the housing; a cylinder block supported in said housing rotationally about an axis of said cam plate, said cylinder block having a plurality of bores radially extending from an axis of rotation of said block; a plurality of pistons displaceably positioned in said bores; a plurality of cylindrical rollers supporting said pistons against said cam plate and each having an axis extending parallel to said axis of rotation, each piston having a transverse bore receiving at least partially a respective roller; and means for axially holding each roller in position in a respective transverse bore, said holding means including stops secured to said cylinder block and abutting against opposite end faces of the respective roller, the improvement comprising each piston including a curved web formed coaxially to an axis of the roller received in said piston, said web surrounding said roller, said cam plate having a plurality of circular grooves each receiving the web of the respective piston.

2. The machine as defined in claim 1, wherein said web is of one piece with the respective piston.

3. The machine as defined in claim 1, wherein said each piston includes a bearing shell for supporting the roller, said bearing shell being positioned in said transverse bore.

4. The machine as defined in claim 3, wherein said bearing shell has flanges provided at both sides of said web so as to anchor said bearing shell to said web in a locking fashion.

* * * * *